US006077126A

United States Patent [19]

Peng

[11] Patent Number: 6,077,126

[45] Date of Patent: Jun. 20, 2000

[54] ELECTRICAL JACK

[75] Inventor: Yao-Che Peng, Tu-Chen, Taiwan

[73] Assignee: Hon Hai Precision Ind. Co., Ltd., Taipei Hsien, Taiwan

[21] Appl. No.: 09/386,536

[22] Filed: Aug. 30, 1999

[30] Foreign Application Priority Data

Jul. 2, 1999 [TW] Taiwan ..... 88211059

[51] Int. Cl.[7] ..... H01R 24/04

[52] U.S. Cl. ..... 439/668; 439/188

[58] Field of Search ..... 439/188, 668, 439/944, 101, 108

[56] References Cited

U.S. PATENT DOCUMENTS 4,398,784 8/1983 Takihara .
4,978,310 12/1990 Shichida ..... 439/668
5,092,795 3/1992 Kitagawa ..... 439/668
5,823,796 10/1998 Bethurum ..... 439/668

*Primary Examiner*—Gary F. Paumen
*Attorney, Agent, or Firm*—Wei Te Chung

[57] ABSTRACT

An electrical jack comprises an insulative housing, a grounding contact, a switch contact, a first signal contact and a second signal contact. The housing defines a front-to-back central hole, a pair of grooves beside the central hole and an opening communicating with the central hole. The grounding contact provides a tongue and a pair of tabs at a distal end of the tongue. The tabs extend into the central hole via the opening. The first and second signal contacts are received in the grooves with, correspondingly, a spring arm and a cantilever thereof partially extending into the central hole of the housing. The switch contact is received in a rear portion of the housing with a vertical plate thereof connecting with the spring arm of the first signal contact.

6 Claims, 6 Drawing Sheets

ELECTRICAL JACK

BACKGROUND OF THE INVENTION

The present invention relates to an electrical jack, and particularly to an electrical jack comprising an insulative housing and a plurality of contacts compactly and securely retained in the housing.

U.S. Pat. Nos. 4,398,784; 5,092,795; and Japanese Patent Nos. 930600 and 979659 each disclose an electrical jack comprising an insulative housing and one or more signal contacts and grounding contacts. The electrical jack disclosed in U.S. Pat. No. 5,092,795 further comprises an insert for securely retaining the signal contacts in the housing, which complicates manufacture and increases costs. Hence, an improved electrical jack is required to overcome the disadvantages of the prior art.

BRIEF SUMMARY OF THE INVENTION

An object of the present invention is to provide an electrical jack comprising an insulative housing and a plurality of contacts compactly and securely retained in the housing.

Accordingly, an electrical jack comprises an insulative housing, a grounding contact, a switch contact, a first signal contact and a second signal contact. The housing defines a front-to-back central hole, a pair of grooves beside the central hole and an opening communicating with the central hole. The grounding contact provides a tongue and a pair of tabs at a distal end of the tongue. The tabs extend into the central hole via the opening. The first and second signal contacts are received in the grooves with, correspondingly, a spring arm and a cantilever thereof partially extending into the central hole of the housing. The switch contact is received in a rear portion of the housing with a vertical plate thereof connecting with the spring arm of the first signal contact.

Other objects, advantages and novel features of the invention will become more apparent from the following detailed description of the present embodiment when taken in conjunction with the accompanying drawings.

DETAILED DESCRIPTION OF THE INVENTION

Figure 1:
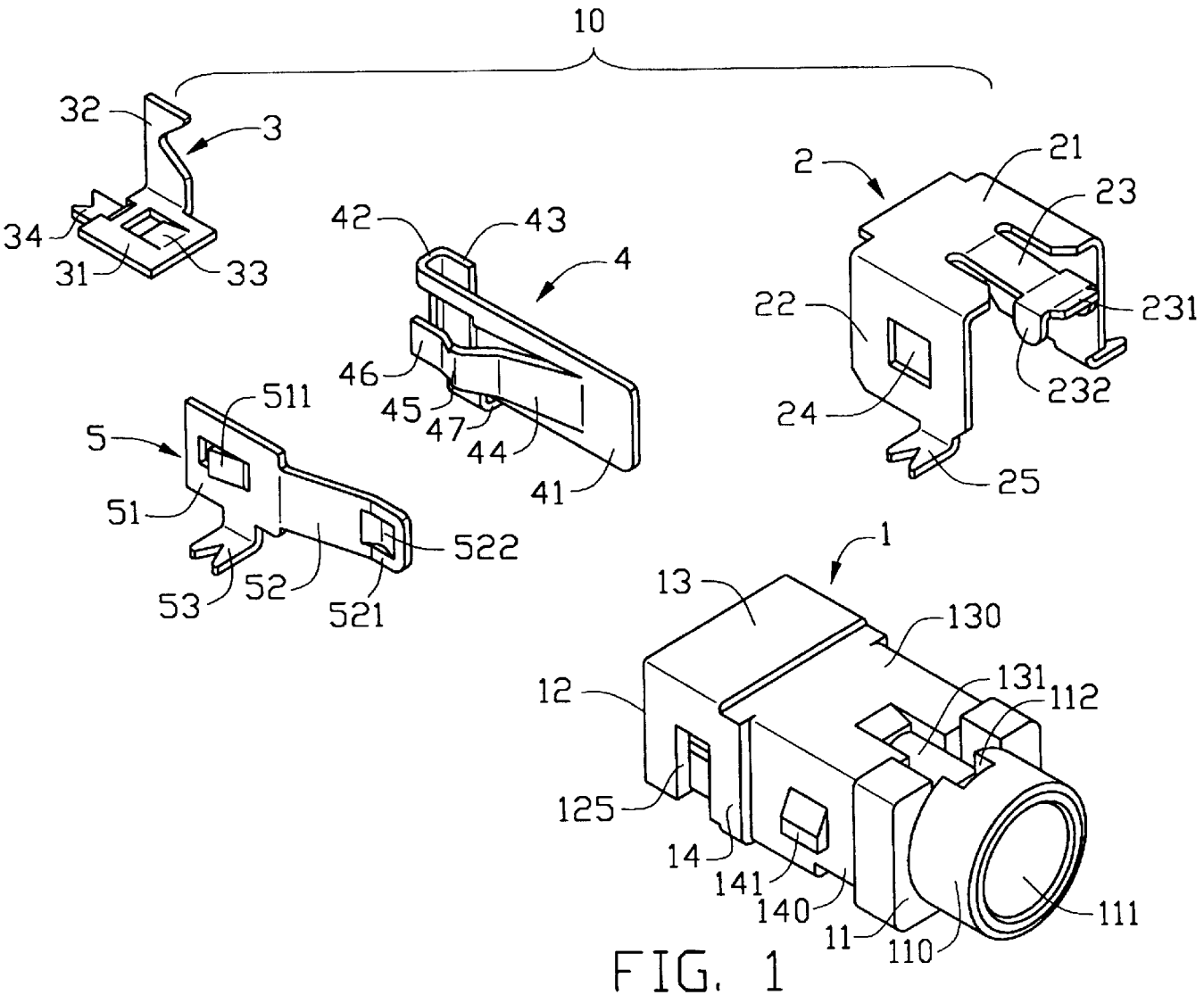
FIG. 1 is an exploded view of an electrical jack in accordance with the present invention.

Referring to FIG. 1, an electrical jack 10 comprises an insulative housing 1, a grounding contact 2, a switch contact 3, a first signal contact 4 and a second signal contact 5. The housing 1 comprises a front face 11, a rear face 12, a top face 13 and a pair of opposite side faces 14. The housing 1 provides a cylindrical mating portion 110 extending from the front face 11 with a central hole 111 defined therein. The housing 1 defines a top recessed surface 130 in the top face 13 and side recessed surfaces 140, 142 (FIG. 2) in the side faces 14. A block 141 is positioned on each side face 14. The housing 1 defines an opening 131 in the top recessed surface 130 communicating with the central hole 111. The opening 131 is adjacent to the cylindrical mating portion 110. The cylindrical mating portion 110 defines a recess 112 in an edge thereof proximate the opening 131. The housing 1 also defines a cutout 125 in one of the side faces 14 thereof.

The grounding contact 2 is substantially U-shaped and comprises a top plate 21 and a pair of side plates 22 extending from opposite edges of the top plate 21. The top plate 21 provides a tongue 23 with a pair of tabs 232 formed on opposite edges of a distal end 231 thereof. Each side plate 22 forms an opening 24. An SMT tail 25 laterally and outwardly extends from a bottom edge of each side plate 22. The switch contact 3 comprises a horizontal plate 31 and a vertical plate 32 extending from an edge of the horizontal plate 31. The horizontal plate 31 provides a downwardly stamped blade 33 and an SMT tail 34. The first signal contact 4 is substantially J-shaped, comprising a main plate 41 and a hook 42 at an end of the main plate 41. The main plate 41 provides a spring arm 44, having an arcuate contact portion 45, laterally stamped therefrom. The hook 42 is substantially U-shaped and has an SMT tail 47 extending from an edge thereof. The second signal contact 5 comprises a retention portion 51, a cantilever 52 extending from a front edge of the retention portion 51 and an SMT tail 53. The retention portion 51 provides a blade 511 laterally stamped therefrom. The cantilever 52 forms a contact portion 522 proximate a free end 521 thereof.

Figure 2:
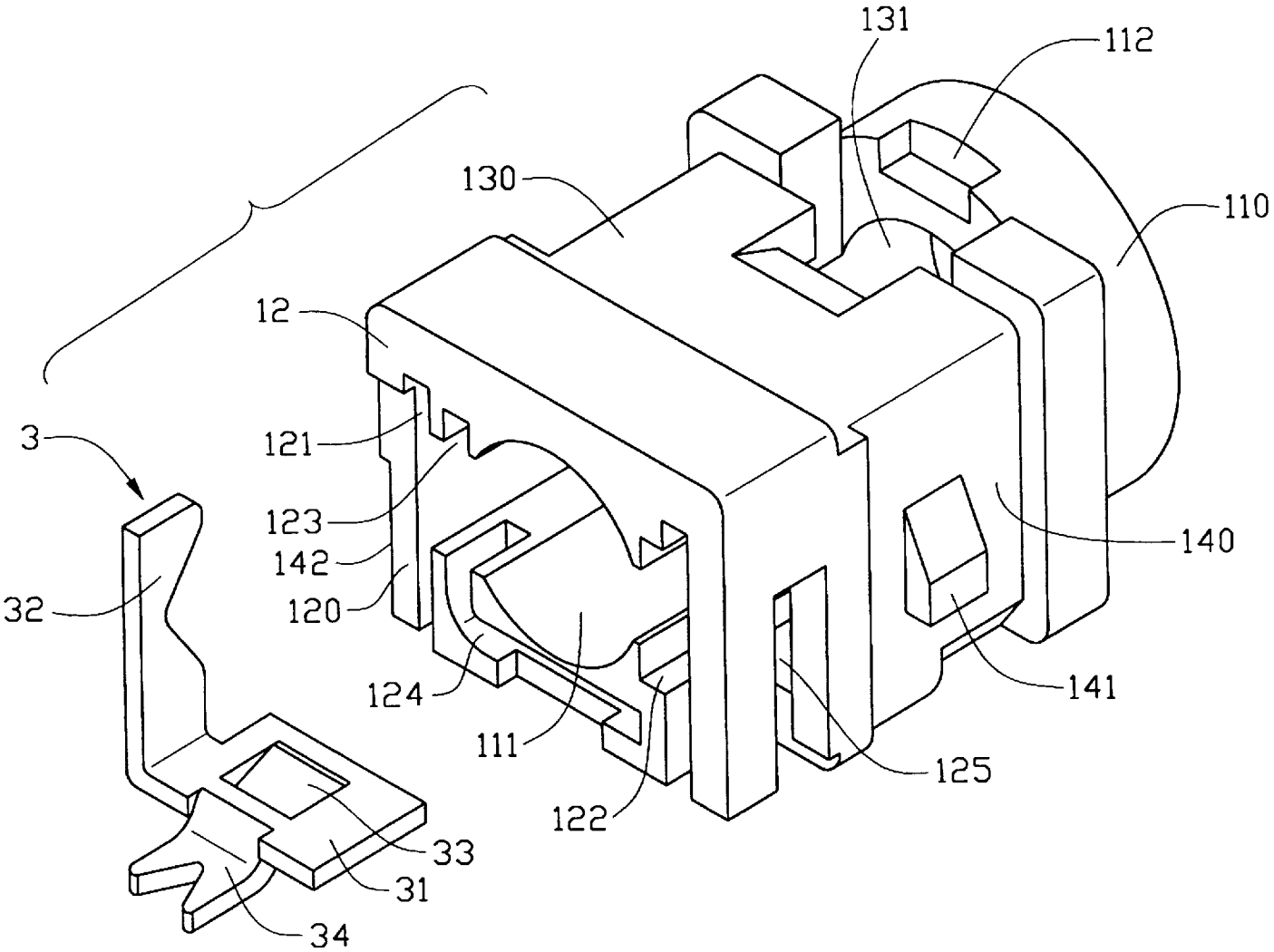
FIG. 2 is a perspective view of an insulative housing and a grounding contact of the electrical jack.

Referring to FIG. 2, the housing 1 defines a pair of grooves 121, 122 beside the central hole 111 and an L-shaped channel 124 below the central hole 111 in the rear face 12. The housing 1 also defines a slot 123 opposite the L-shaped channel 124 in the rear face 12.

Figure 3:
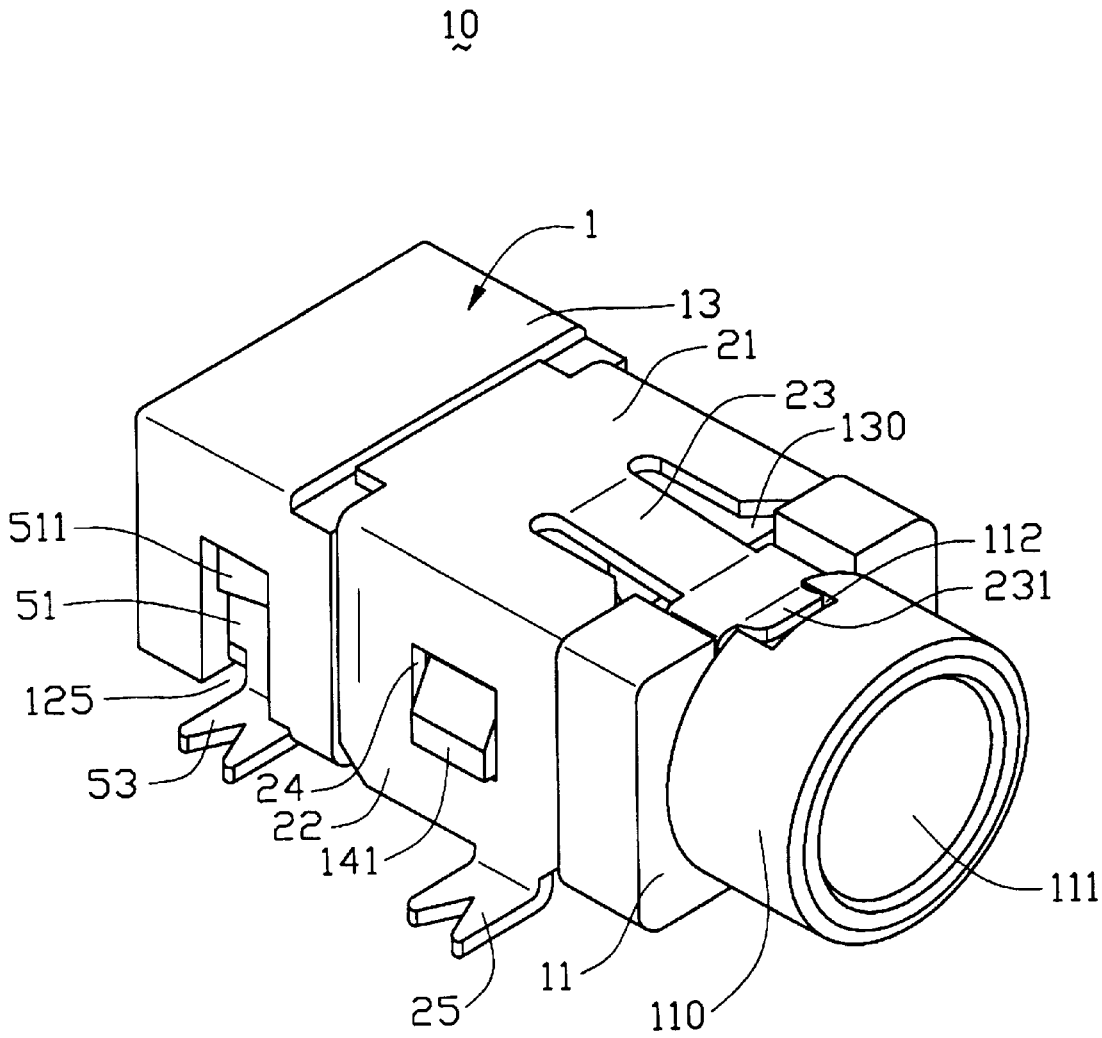
FIG. 3 is a perspective view of the assembled electrical jack.
Figure 4:
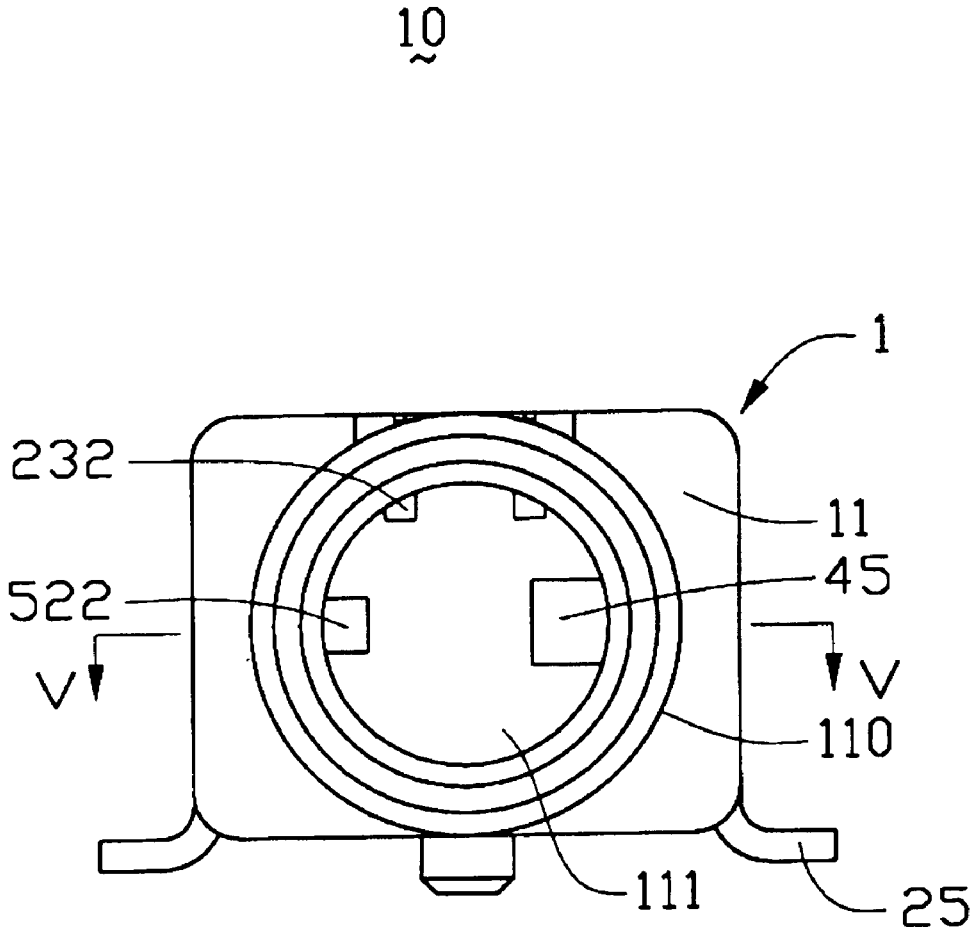
FIG. 4 is a front view of the assembled electrical jack.
Figure 5:
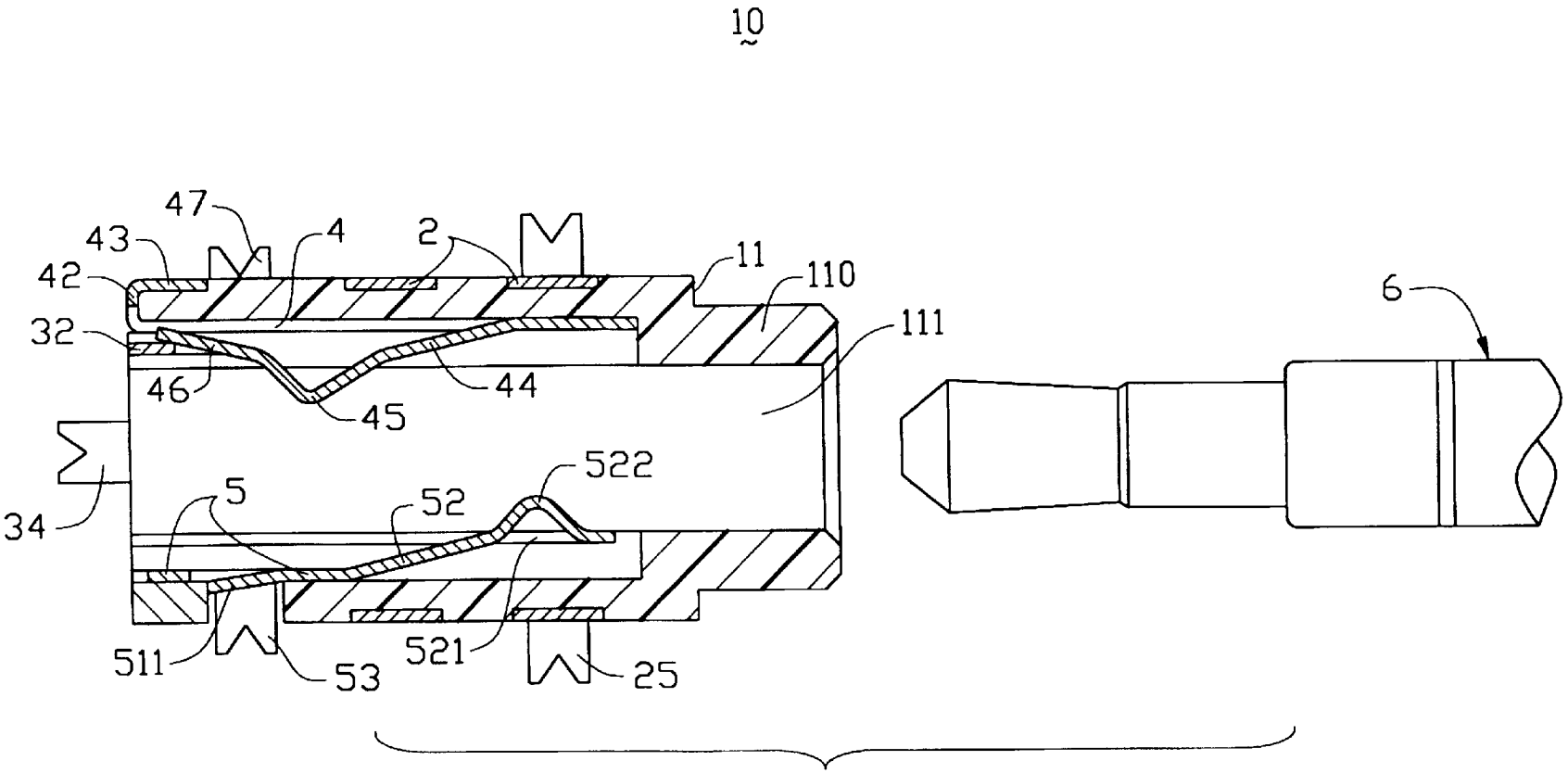
FIG. 5 is a cross-sectional view of the assembled electrical jack taken along line 5—5 of FIG. 4 and a mating plug connector.

Also referring to FIGS. 3–5, in assembly, the first and second signal contacts 4, 5 are respectively received in the grooves 121, 122 from the rear face 12 of the housing 1. The contact portions 45, 522 of the spring arm 44 and the cantilever 52 extend into the central hole 111. The hook 42 engages a side wall 120 of the housing 1 with a free end 43 thereof securely abutting against the recessed surface 142. The blade 511 is received in the cutout 125 and a free end thereof abuts against a peripheral wall of the cutout 125 thereby preventing rearward movement of the second signal contact 5 relative to the housing 1. The switch contact 3 is received in the L-shaped channel 124 and a free end of the vertical plate 32 is received in the slot 123. The blade 33 abuts a periphery of the L-shaped channel 124. A distal end 46 of the spring arm 44 is resiliently connected with the vertical plate 32 of the switch contact 3. The grounding contact 2 is downwardly assembled to the housing 1 with the openings 24 thereof receiving the blocks 141 and the tabs 232 of the tongue 23 extending into the central hole 111 of the housing 1 via the opening 131. The distal end 231 of the tongue 23 resiliently abuts against the recess 112 of the housing 1.

Figure 6:
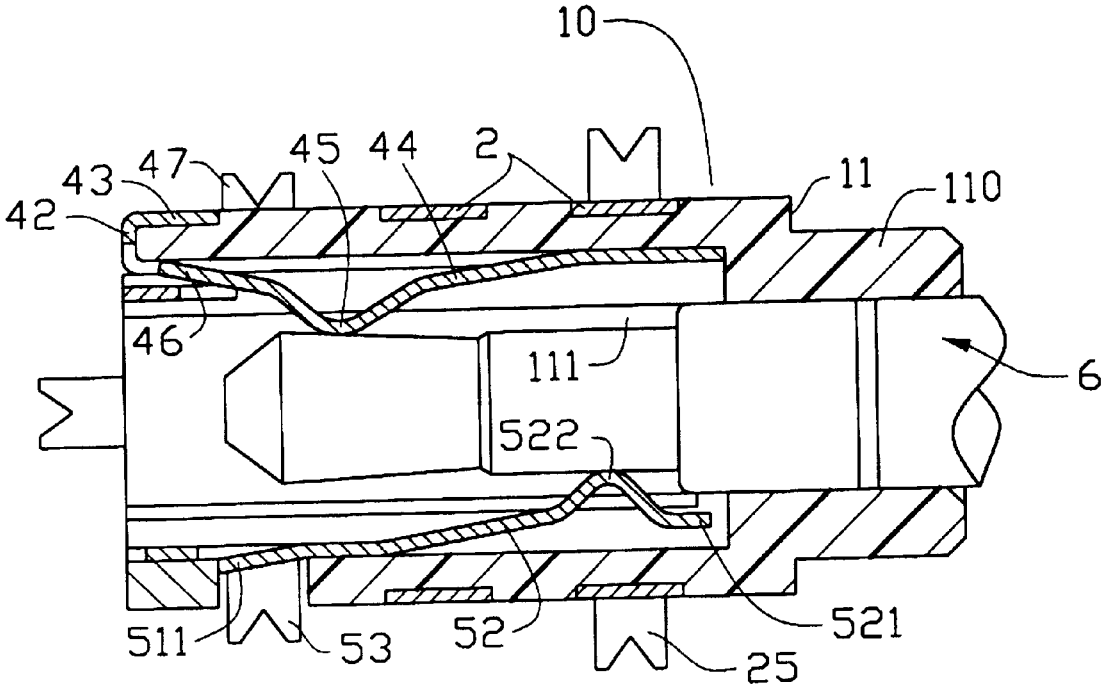
FIG. 6 is similar to FIG. 5 with the mating plug connector inserted into the electrical jack.

Referring to FIG. 6, when a mating plug connector 6 is mated with the electrical jack 10, the mating connector 6 pushes the spring arm 44 of the first signal contact 4 and the cantilever 52 of the second signal contact 5 to move outwardly. The distal end 46 of the first signal contact 4 is then distanced from the vertical plate 32 of the switch contact 3. The mating connector 6 securely engages the contact portion 45 of the spring arm 44, the contact portion 522 of the second signal contact 5 and the tabs 232 of the grounding contact 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical jack comprising:

an insulative housing defining a central hole between a front face and a rear face thereof, a pair of grooves in opposite side walls thereof, an opening communicating with the central hole, and a generally L-shaped channel in the rear face;

a first signal contact comprising a hook at an end thereof and a spring arm, the first signal contact being secured in the corresponding groove of the housing, the hook engaging with a selected side wall of the housing and the spring arm partially extending into the central hole of the housing;

a second signal contact comprising a retention portion and a cantilever extending from the retention portion, the second signal contact being secured in the other groove of the housing, the cantilever partially extending into the central hole of the housing;

a grounding contact comprising a tongue having a pair of tabs downwardly extending from opposite edges of a distal end of the tongue, the tabs extending through the opening into the central hole; and a switch contact comprising a horizontal plate and a vertical plate, the switch contact secured in the channel of the housing from a rear direction, the vertical plate being constantly engaging the distal end of the spring arm while being disengaged therefrom in response to insertion of a mating connector into the central hole of the insulative housing.

2. The electrical jack as claimed in claim 1, wherein the housing defines an outer recessed surface in the selected side wall thereof and wherein a free end of the hook abuts against the recessed surface.

3. The electrical jack as claimed in claim 1, wherein the L-shaped channel is disposed below the central hole.

4. The electrical jack as claimed in claim 3, wherein the housing defines a slot in a top wall thereof opposing to the L-shaped channel, and wherein a free end of the vertical plate of the switch contact is received in the slot.

5. An electrical jack comprising:

an insulative housing defining a central hole between a front face and a rear face thereof;

a first signal contact received within the housing with a first spring arm extending into the central hole and with a first SMT tail horizontally outwardly extending from a first side of the housing;

a second signal contact received within the housing with a second spring arm extending into the central hole and with a second SMT tail horizontally outwardly extending from a second side of the housing which is opposite to said first side;

a grounding contact attached to the housing with a tongue extending into the central hole and with a pair of third SMT tails horizontally outwardly extending from the first side and the second side of the housing, respectively; and a switch contact inserted into the housing from a rear portion thereof, said switch including a fourth SMT tail horizontally outwardly extending from a third side of the housing which is perpendicular to both the first and second sides of the housing, and a vertical plate engageable with/disengageable from one of the first and second spring arms in response to withdrawal/insertion of the mating connector from/into the housing.

6. An electrical jack comprising:

an insulative housing including a cylindrical mating portion defining a central hole between a front face and a rear face thereof;

a first signal contact received within the housing with a first spring arm extending into the central hole;

a second signal contact received within the housing with a second spring arm extending into the central hole; and a grounding a switch contact; contact attached to the housing with a tongue extending into the central hole, a pair of tabs downwardly extending from two opposite side edges of a distal end of said tongue; wherein an opening is formed in an upper portion of the housing in communication with the central hole, and said opening cooperates with a recess formed in an edge of the cylindrical mating portion to commonly form a cross-like cavity so the tongue and the associated tabs are received in said cross-like cavity and extend into the central hole thereunder for engagement with a mating connector inserted into the central hole.

* * * * *